United States Patent [19]

Mizuma et al.

[11] Patent Number: 5,044,223

[45] Date of Patent: Sep. 3, 1991

[54] PEDAL DEPRESSION ASSISTING MECHANISM

[75] Inventors: Hiroyuki Mizuma, Hatano; Yasushi Asano; Yoshimasa Kataumi, both of Shizuoka, all of Japan

[73] Assignees: Nissan Motor Co., Ltd., Yokohama; Fuji Kiko Co., Ltd., Tokyo, both of Japan

[21] Appl. No.: 354,163

[22] Filed: May 19, 1989

[30] Foreign Application Priority Data

May 21, 1988 [JP] Japan ..... 63-67060[U]

[51] Int. Cl.[5] ..... G05G 1/14

[52] U.S. Cl. ..... 74/512; 74/560; 192/111 A

[58] Field of Search ..... 74/512, 519, 514, 513, 74/531; 192/111 A, 33 S; 188/136 BA

[56] References Cited

U.S. PATENT DOCUMENTS

| | | | |
|---|---|---|---|
| 4,800,774 | 1/1989 | Hagiwara et al. | 192/111 A X |
| 4,846,012 | 7/1989 | Papenhagen et al. | 74/519 X |
| 4,850,242 | 7/1989 | Hass et al. | 74/531 X |
| 4,907,468 | 3/1990 | Hagiwara et al. | 74/512 |

FOREIGN PATENT DOCUMENTS

| | | | |
|---|---|---|---|
| 3636748 | 5/1987 | Fed. Rep. of Germany . | |
| 2365161 | 4/1978 | France . | |
| 2560316 | 8/1985 | France . | |
| 56-35382 | 8/1981 | Japan | 74/512 |
| 2082284 | 3/1982 | United Kingdom . | |
| 2117076 | 10/1983 | United Kingdom . | |

*Primary Examiner*—Vinh T. Luong

*Attorney, Agent, or Firm*—Pennie & Edmonds

[57] ABSTRACT

A pedal depression assisting mechanism is provided with first and second assist spring units. The first assist spring unit applies to a pedal arm a depression resisting force upon rotation of the pedal arm between a rest position and a transition position and a depression assisting force upon rotation of the pedal arm exceeding the transition position. The second assist spring unit applies to the pedal arm a depressing assisting force upon rotation of the pedal arm between the rest position and the transition position. The second assist spring unit becomes ineffective on the pedal arm when the pedal arm is in the transition position or rotated beyond the transition position.

3 Claims, 7 Drawing Sheets

PEDAL DEPRESSION ASSISTING MECHANISM

BACKGROUND OF THE INVENTION

1. Field of the Invention

The present invention relates in general to a clutch for a vehicle such as an automobile and more particularly to a clutch pedal depression assisting mechanism for assisting or boosting depression on a clutch pedal.

2. Description of the Prior Art

Two different types of mechanisms for assisting depression of a clutch pedal are the diaphram spring type and the coil spring type. In general, a diaphram spring type clutch unit has such a clutch pedal depressing force characteristic as indicated by a dotted line curve "T" in FIG. 5. In order to reduce the necessary clutch pedal depressing force and thereby make it possible to operate the clutch with less effort, a so-called turnover mechanism, servomotor, etc. is used. In many small-sized cars, the turnover mechanism is used.

An example of a turnover mechanism is disclosed in Japanese Provisional Patent Publication No. 55-55022 and constructed so that an assist coil spring resists rotation of a clutch pedal upon rotation of same between a rest position and a turnover or transition position and assists the rotation upon rotation of the clutch pedal exceeding the turnover position. This mechanism effects such a depressing force variation charactreristic as indicated by a one-dot chain line curve "R0" in the graph of FIG. 6A. In the graph, indicated by "A" is the turnover position.

In the above described turnover mechanism, an increase in the force exerted by the assist spring services to increase the depression assisting for. This however increases the necessary pedal depressing force "V" (refer to FIG. 5) at the begining of rotation of the clutch pedal. In order to solve this problem, it has been proposed to employ a second assist spring as disclosed in Japanese Provisional Utility Model Publication No. 61-39635. The second assist spring exerts such a pedal depression assiting force as indicated by a two-dot chain line in FIG. 6B. The two assist springs effect such a combined assisting force variation characteristic as indicated by the two-dot chain line "R1" in FIG. 6A. The dotted line curve "T" in FIG. 5 indicates an example of a depressing force variation characteristic or a clutch operating force variation charactristic of a clutch unit of itself. The two-dot chain line curve R3 is obtained by combining the characteristic curves "R1" and "T".

A disadvantage of the turnover mechanism having two assist springs is that the return speed of the clutch pedal becomes slower by the provision of the second spring. This will be apparent from the comparision between the chracteristic curves "R0" and "R1" since the turnover position "A" is moved into position "A'" which corresponds to a rotated position of the clutch pedal nearer to its rest position. Another disadvantage is that a feel of operation of the clutch pedal is not good since the necessary pedal depressing force varies largely in response to variation of the pedal stroke as will be understood from the characteristic curve "R3".

SUMMARY OF THE INVENTION

In accordance with the present invention, there is provided a pedal depression assisting mechanism which comprises a stationary support, a pedal arm rotatably installed on the support, first assist spring means for urging the pedal arm in one direction upon rotation the pedal arm between first and second positions and in the opposite direction upon rotation of the pedal arm exceeding the second position, and second assist spring means for urging the pedal arm in the opposite direction upon rotation of the pedal arm between the first and second positions. The second assist spring means becomes ineffective on the pedal arm when the pedal arm is in the second position or rotated beyond the second position.

The above mechanism is effective for overcoming the above noted disadvantages of the prior art device.

It is accordingly an object of the present invention to provide a pedal depression assisting mechanism which can exert a larger depression assisting force without making slower the return speed of the clutch pedal.

It is another object of the present invention to provide a pedal depression assisting mechanism of the above described character which can effect a good feel of operation of the clutch pedal.

It is a further object of the present invention to provide a pedal depression assisting mechanism of the above described character which can make smoother the variation of the necessary pedal depressing force in response to variation of the pedal stroke.

DESCRIPTION OF THE PREFERRED EMBODIMENTS

Figure 1:
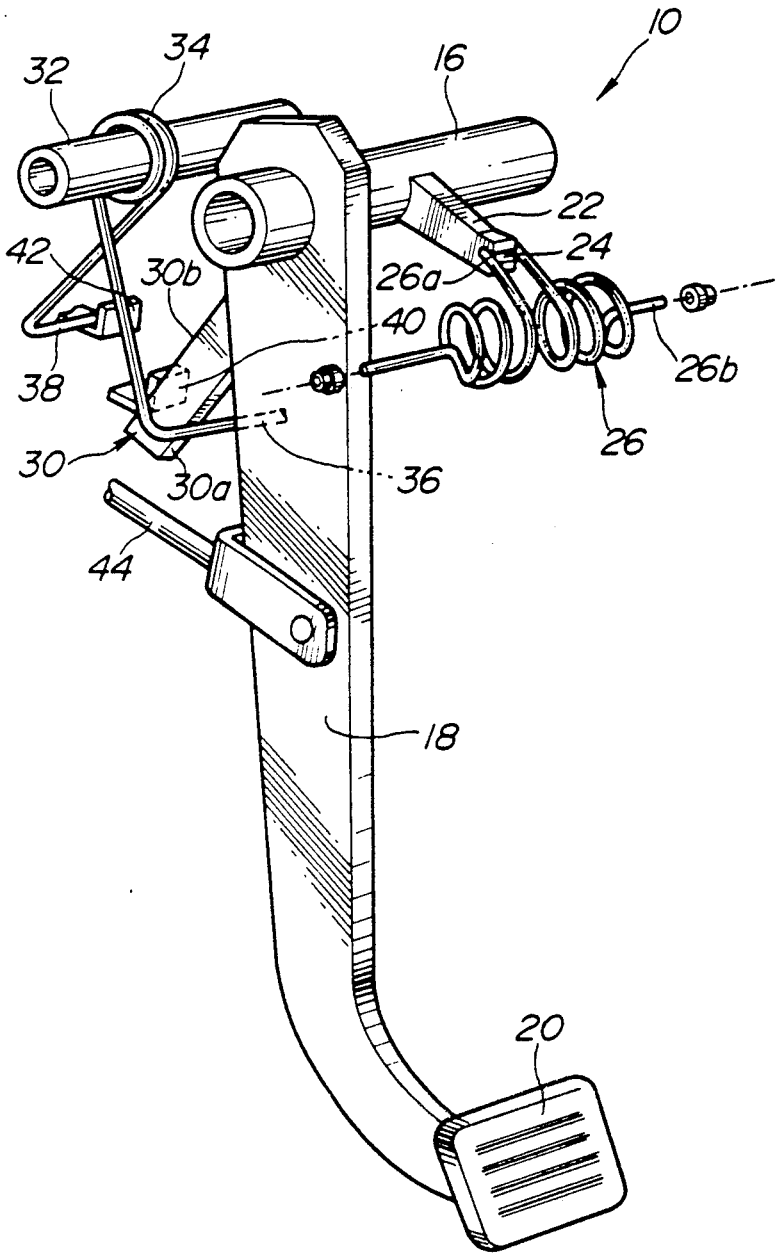
FIG. 1 is a perspective view of a pedal depression assisting mechanism, with some parts being omitted, according to an embodiment of the present invention.

Referring to FIGS. 1 to 4, a pedal depression assisting mechanism 10 according to an embodiment of the present invention includes a bracket 12 fixedly attached to a vehicle body 14, a fulcrum shaft or tube 16 rotatably supported by the bracket 12 and a pedal arm 18 secured at an upper end portion to the fulcrum tube 16 so as to be rotatable together with the fulcrum tube 16 relative to the bracket 12. The pedal arm 18 extends away from the fulcrum tube 16 toward a lower end portion. A pedal pad 20 is secured to the lower end portion of the pedal arm 18 to constitute a clutch pedal 21. A first assist lever 22 is secured at a first end portion to the fulcrum tube 16 and extends away from the fulcrum tube 16 toward a second end portion. The pedal arm 18 and assist lever 22 are arranged so as to extend away from the fulcrum tube 16 in the different directions and make a predetermined angle with each other when viewed in a plane of projection perpendicular to the axis of rotation of the fulcrum tube 16. The second end portion of the assist lever 22 is formed with a notch 24 in which a first end portion 26*a* of a first assist coil spring 26 is rotatably received. The assist spring 26 has a second end portion 26*b* rotatably attached to an arm 28 which is in turn secured to the bracket 12. The assist lever 22, assist spring 26 and arm 28 are constructed and arranged so that the assist spring 26 produces a resistance to rotation of the pedal arm 18 during rotation of the pedal arm 18 from a rest position (i.e., a position into which the pedal arm 18 is put when the pedal pad 20 is free from depression) to a predetermined rotated position (i.e., a turnover or transition position) and then changes in action to assist or boost the rotation of the pedal arm 18 away from the rest position when the pedal arm 18 is rotated beyond the above described predetermined position.

A second assist lever 30 is located adjacent the pedal arm 18 and between the pedal arm 18 and the first assist lever 22. The second assist lever 30 is secured at the first end to the fulcrum tube 16 and extends away from the fulcrum tube 16 toward a second end portion. The second assist lever 30 and pedal arm 18 are arranged so as to extend away from the fulcrum tube 16 in the different directions and make a predetermined angle with each other when viewed in a plane of projection perpendicular to the axis of rotation of the fulcrum tube 16. More specifically, the pedal arm 18, first assist lever 22 and second assist lever 30 are arranged so as to make the second end portions of the first and second assist levers 22 and 30 be located on the opposite sides of the pedal arm 18 when viewed in the plane of projection perpendicular to the axis of rotation of the fulcrum tube 16.

A shaft or tube 32 is arranged in parallel to the fulcrum tube 16 and secured to the bracket 12. A second assist coil spring 34 is wound or placed around the tube 32 and has a first end portion 36 abutting upon a first edge 30*a* of the second assist lever 30 nearer to the pedal arm 18 and a second end portion 38 which is movable being pushed by a second edge 30*b* of the second assist lever 30 opposite to the above described first edge 30*a* to twist the second assist spring 34. The first and second end portions 36 and 38 of the second assist spring 34 are bent to extend substantially parallely to the fulcrum tube 16 so that the opposite first and second edges 30*a* and 30*b* of the second assist lever 30 can assuredly abut upon the first and second end portions 36 and 38, respectively.

Stoppers 40 and 42 are secured to the bracket 12 and capable of abutting upon the first and second end portions 36 and 38 of the second assist spring 34, respectively. The second assist spring 34 is constructed and arranged so as to make, when the pedal arm 18 is in the rest position, the first end portion 36 be forced to abut upon the first edge 30*a* of the second assist lever 30 to assist the rotation of the pedal arm 18 away from the rest position while the second end portion 38 be forced to contact the stopper 42. A push rod or control cable 44 connects the pedal arm 18 to a clutch unit (not shown).

Figure 2:
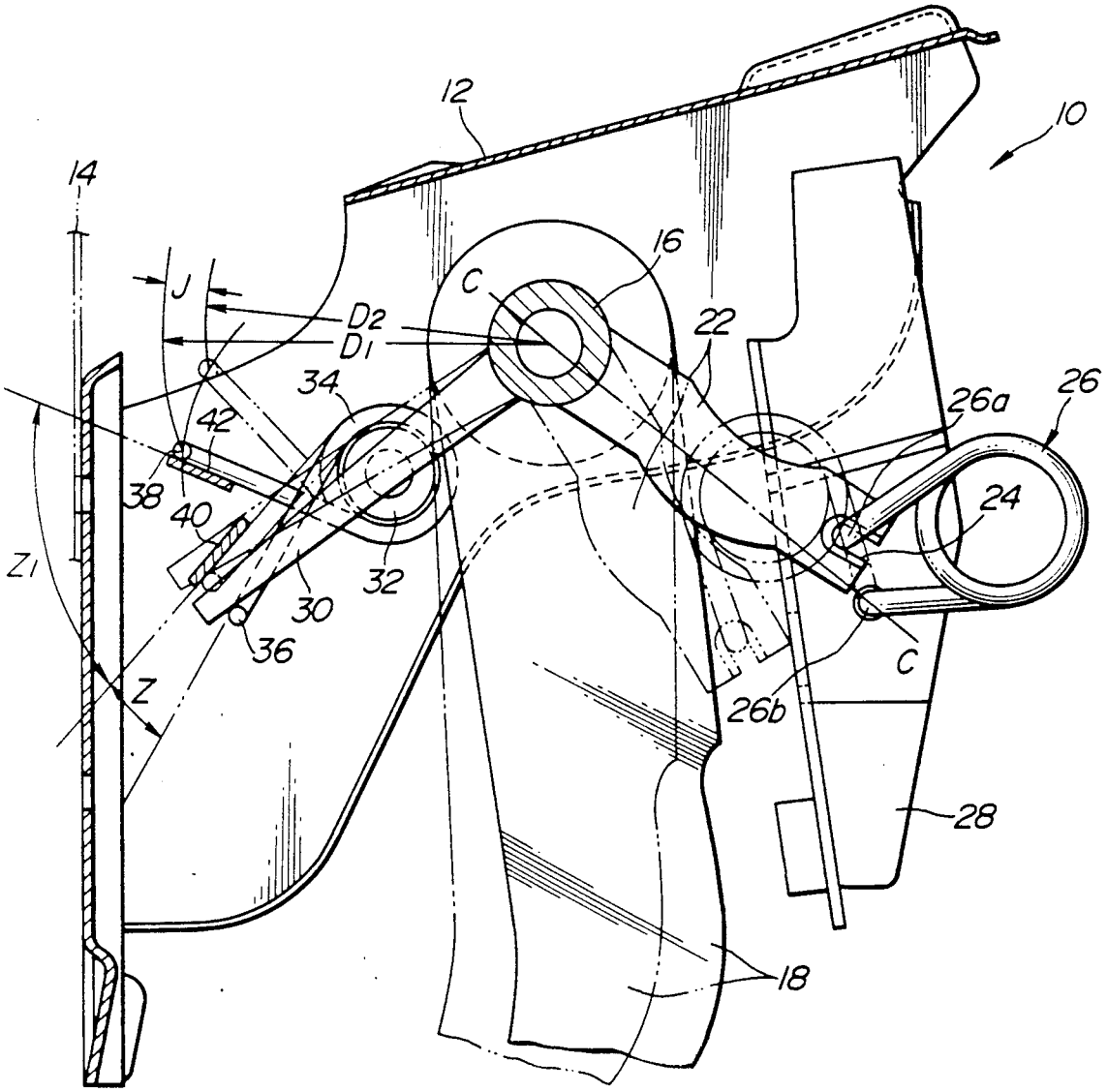
FIG. 2 is a fragmentary sectional view of the pedal depression assisting mechanism of FIG. 1.

The pedal depression assisting mechanism operates as follows. In FIG. 2, the pedal arm 18, first and second assist levers 22 and 30 and first and second assist springs 26 and 34, etc. are shown by the solid lines in the positions into which they are put when the pedal pad 20 is free from depression and also shown by the two-dot chain lines in the positions into which they are put when the pedal pad 20 is depressed.

When the pedal pad 20 is depressed to rotate the pedal arm 18 away from the rest position about the fulcrum tube 16, the first assist lever 22 is rotated about the fulcrum tube 16 clockwise in FIG. 2. In this instance, the first assist spring 26 resists the rotation of the pedal arm 18 until the first assist lever 22 is rotated to the above described predetermined position (turnover position or transition position) indicated in FIG. 2 by the line C—C which is obtained by interconnecting, with respect to a plane of projection perpendicular to the axis of rotation of the fulcrum tube 16, the center axis of the second end portion 26*b* of the first assist spring 26 attached to the arm 28 and the center axis of the fulcrum tube 16. The transition position C—C corresponds to the position "A" in the graphs of FIGS. 5 and 6A-6B. When the assist lever 22 is rotated beyond the transition position C—C, the first assist spring 26 changes its action on the pedal arm 18 to assist or boost the rotation of the pedal arm 18 away from the rest position.

The second assist lever 30 is urged clockwise in FIG. 2 by the second assist spring 34 until the first end portion 36 of the second assist spring 34 comes to abut upon the stopper 40, i.e., during movement of the first end portion 36 of the second assist spring 34 within the zone indicated by the angle "Z" in FIG. 2. This zone "Z" is designed so as to correspond to the rotation of the pedal arm 18 between the rest position and the transition position "A" as seen from the graph of FIG. 6B. The second assist spring 34 thus applies a depression assisting force to the pedal arm 28 during rotation of the clutch pedal between the rest position and the transition position "A". After the first end portion 36 of the second assist spring 34 comes to abut upon the stopper 40, further rotation of the pedal arm 18 allows the first edge 30*a* of the second assist lever 30 to move away from the first end portion 36 of the second assist spring 34. When the first edge 30*a* of the second assist lever 30 is located between the stoppers 40 and 42, i.e., in the zone indicated by the angle "Z1" in FIG. 2, the second assist spring 34 does not apply any depression assisting force to the pedal arm 18 as also seen from the graph of FIG. 6B. When this is the case, the rotation of the pedal arm 18 is boosted only by the first assist spring 26.

Further depression on the pedal pad 20 causes the second assist lever 30 to abut at the second edge 30*b* upon the second end portion 38 of the second assist spring 34 and then move together with same. In this instance, the first end portion 36 is held in contact with the stopper 40, thus allowing the second assist spring 34 to be twisted. Accordingly, the second assist spring 34 resists the rotation of the pedal arm 18 after the second assist lever 30 comes to abut upon the second end portion 38 of the second assist spring 34 as is also seen from the graph of FIG. 6B. In this instance, the second end portion 38 of the second assist spring 34 slides on the second edge 30*b* of the second assist lever 30 toward the center of rotation of the fulcrum tube 16 such that the distance between the center axis of the second end portion 38 of the second assist spring 34 and the axis of rotation of the fulcrum tube 16 changes from D1 to D2 ($D1-D2=J$). Accordingly, when the clutch pedal 19 is depressed increasingly toward a position of maximum rotation through a clutch disengagement position "C" after the second assist lever 30 comes to abut upon the second end portion 38 of the second assist spring 34, the rated increase of the resistance by the second assist spring 34 reduces gradually as the clutch pedal 19 is depressed increasingly toward the position of maximum rotation.

When the clutch pedal 19 in the position of maximum rotation or position is released from the depression, the second assist lever 30 is driven counterclockwise in FIG. 2 by the second assist spring 34, thus causing the pedal arm 18 to rotate counterclockwise to allow the second end portion 38 of the second assist spring 34 to abut upon the stopper 42 and thereafter the second assist lever 30 to abut upon the first end portion 36 of the second assist spring 34. The first end portion 36 of the second assist spring 34 is thus caused to move together with the second assist lever 30 and go increasingly away from the second end portion 38. The second assist spring 34 thus applies to the second assist lever 30 a resistance to the return rotation of the pedal arm 18 after the second assist lever 30 comes to abut upon the first end portion 36 of the second assist spring 34. On the other hand, the first assist spring 26 resists the return rotation of the pedal arm 18 until its end portion **26*a* attached to the first assist lever 22 passes the transition position C—C but, once passes the transition position C—C, it changes its action to assist the return rotation of the pedal arm 18**.

Figure 5:
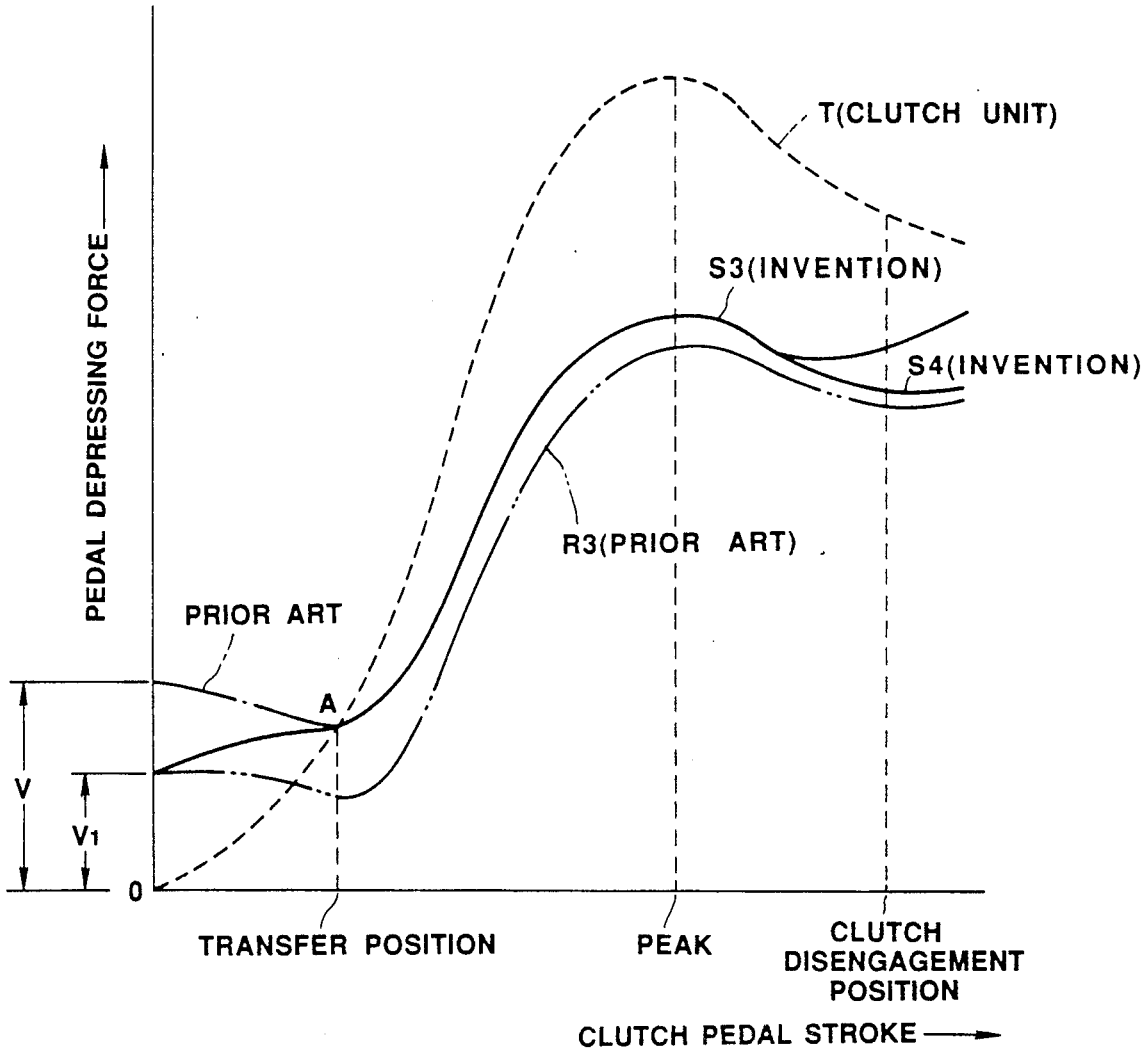
FIG. 5 is a graph showing a clutch pedal depressing force for a clutch pedal stroke.
Figure 6A:
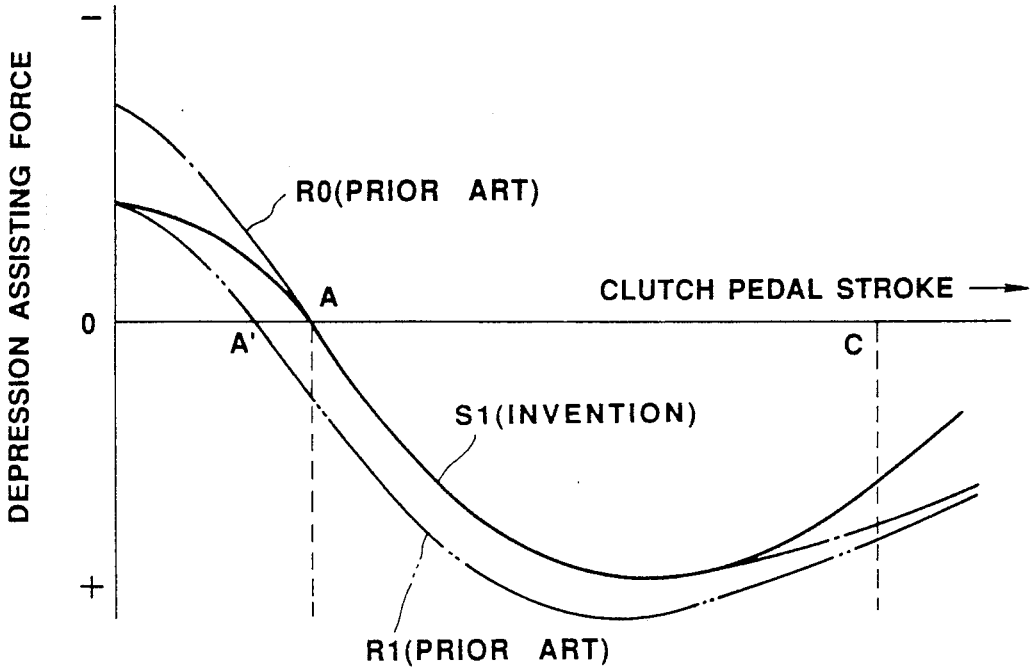
FIG. 6A is a graph showing a depression assisting force exerted by a first assist spring for a pedal stroke.
Figure 6B:
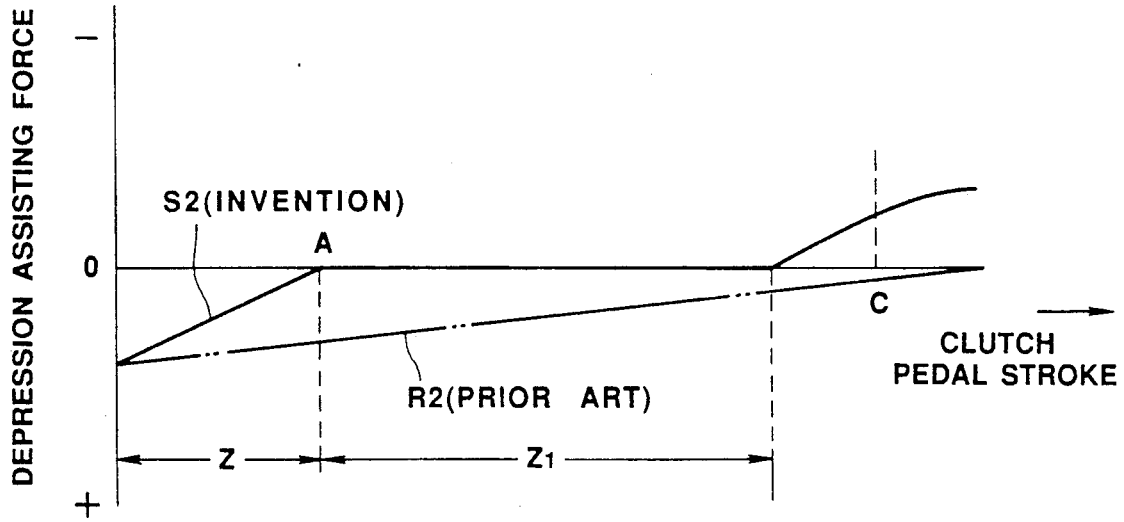
FIG. 6B is a graph showing a depression assiting force exerted by a second assist spring for a pedal stroke.

The solid line curve "S1" in FIG. 6A indicates a depression assisting force produced by the first assist spring 26 in relation to rotation of the pedal arm 18. The solid line curve "S2" in FIG. 6B indicates a depression assisting force produced by the second assist spring 34 in relation to rotation of the pedal arm 18. The dotted line curve "T" in FIG. 5 indicates a depressing force for a clutch pedal rotation or stroke when the clutch linkage arrangement is not provided with any clutch pedal depression assisting unit. In other words, the dotted line curve "T" indicates a clutch unit operating force variation characteristic or a resistance produced by the clutch unit of itself in relation to movement of a clutch release lever (not shown). The solid line curve "S3" in FIG. 5 is obtained by combining the curves "S1" and "S2" with the curve "T". As will be apparant from the comparison between the curves "S3" and "R3", the second assist spring 34 makes it possible to reduce the necessary depressing force at the begining of rotation of the pedal arm 18 away from the rest position without causing movement of the transition position "A". Further, it becomes possible to make smoother the variation of clutch pedal depressing force for clutch pedal stroke. Accordingly, a good feel of operation of the clutch pedal 19 is attained. Furthermore, variation of the clutch pedal depressing force can be smooth between the peak point (i.e., the point at which the necessary depressing force becomes maximum "P" and the clutch disengagement point "C", thus making it possible to further improve the feel of operation of the clutch pedal 19.

Figure 3A:
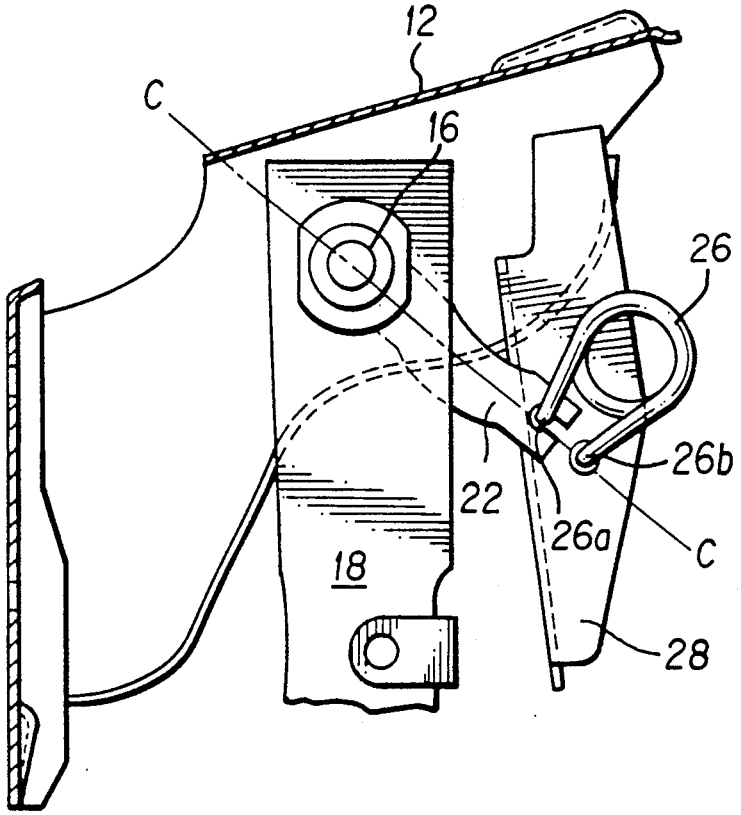
FIG. 3A is a partial view of FIG. 3, which shows the position of the first spring when the pedal arm is in the second position.
Figure 3:
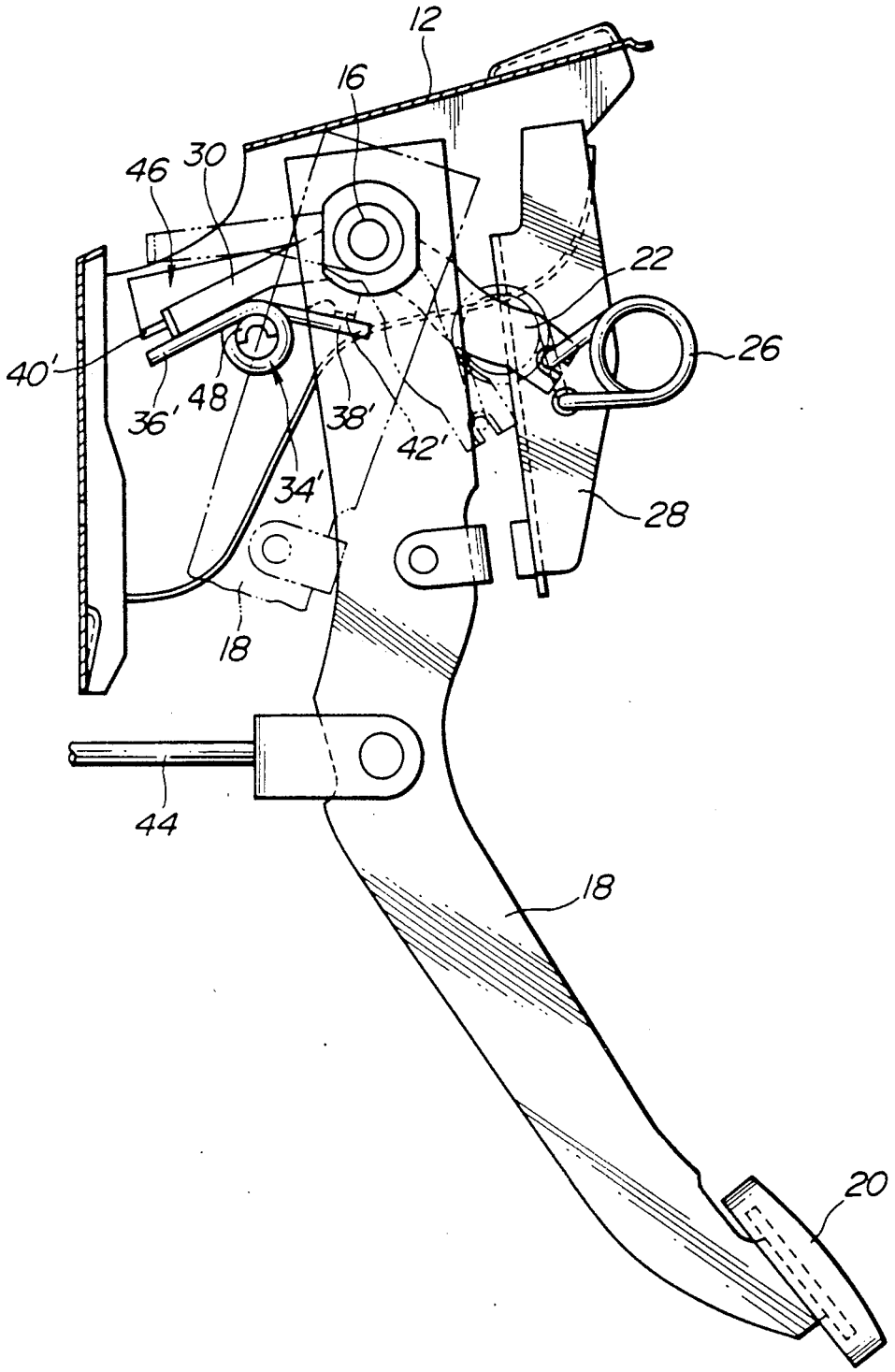
FIG. 3 is a side elevational view partly in section of a pedal depression assisting mechanism according to another embodiment of the present invention.
Figure 4A:
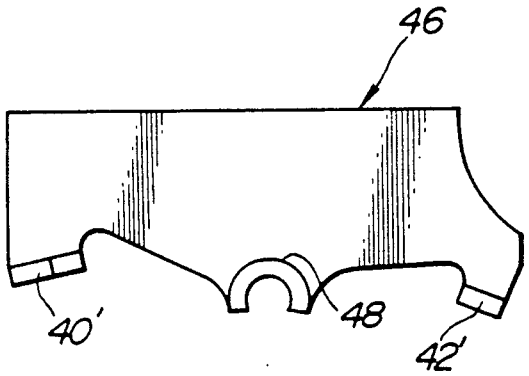
FIG. 4A is a fragmentary elevational view of the pedal depression assisting mechanism of FIG. 3.
Figure 4B:
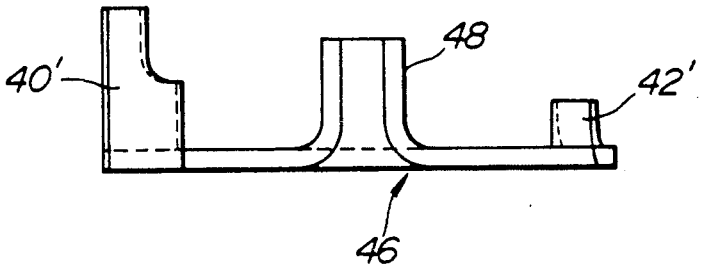
FIG. 4B is a top plan view of the pedal depression assisting mechanism of FIG. 4A.

FIGS. 3 and 4A–4B show another embodiment, in which parts and portions similar to those of the previous embodiment are designated by the same reference characters.

This embodiment differs from the previous embodiment in that a holder 46 for installation of a second assist coil spring 34' is secured to the inner wall of the bracket 12 in such a way that the second assist spring 34' applies a depression assisting force to the pedal arm 18 when the pedal arm 18 is rotated from the rest position to the transition position. FIG. 3A shows a partial view of FIG. 3, with certain elements removed for clarity of illustration. When the pedal arm 18 is in the transition position C—C, as shown in FIG. 3A, the center axis of the first end portion **26*a* and the center axis of the second end portion 26*b* of the first assist spring 26 and the axis of rotation of the pedal arm 18 are positioned on a straight line C—C. The depression assisting force is maintained zero when the pedal arm 18 is rotated beyond the transition position. As shown in FIGS. 4A and 4B, the holder 46 has first and second stoppers 40' and 42' for engagement with the first and second end portions 36' and 38' of the second assist spring 36'. The holder 46 further has an integral projection 48 of semicircuar cross section, on which the coiled part of the second assist spring 34' is installed, i.e., the second assist spring 34' is wound or placed around the projection 46 to be supported thereon. The solid line curve "S4" in FIG. 5 is obtained by combining the dotted line curve "T" and a depression assisting force characteristic curve (not shown) effected by the second assist spring 34'. The curve "S4" is coincident with the curve "S3" except for the portion adjacent the clutch disengagement point "C". As will be understood from the characteristic curve "S4", this embodiment is constructed so that the depression assisting force to be applied to the second assist lever 30' becomes zero when the first end portion 36' of the second assist spring 34' abuts upon the second stopper 42'. This embodiment is thus effective for improving the feel of operation of the clutch pedal 19 at the begining of rotation of the clutch pedal 19** away from the rest position.

While the second assist spring has been described and shown as above, it is not imitative but rather another coil spring may be used which is constructed and arranged so that a first end portion is held stationary and a second end portion is put into a freely movable condition when the pedal arm is depressed into or beyond the transition position.

What is claimed is:

1. A pedal depression assisting mechanism comprising:

a stationary bracket;

a pedal arm rotatably installed on said bracket;

first assist spring means for urging said pedal arm in one direction upon rotation of said pedal arm between first and second positions and in the opposite direction when rotation of said pedal arm goes beyond said second position; and second assist spring means for urging said pedal arm in said opposite direction upon rotation of said arm between said first and second positions, said second assist spring means becoming ineffective on said pedal arm when said pedal arm is in said second position or rotated beyond said second position;

in which said second assist spring means includes a second assist spring and a second assist lever rotatable together with said pedal arm in such a manner as to be held engaged with said second assist spring upon rotation of said pedal arm between said first and second positions and held disengaged from said second assist spring upon rotation of said pedal arm exceeding said second position;

in which said second assist spring is a coil spring having opposite first and second end portions, and said second assist spring means further includes two stoppers upon which said first and second end portions of said second assist spring abut so as to be held stationary thereon when rotation of said pedal arm goes beyond said second position.

2. The mechanism according to claim 1 wherein said first end portion of said second assist spring is movable together with said second assist lever while said second end portion is held engaged with one of said stoppers upon rotation of said pedal arm between said first and second positions.

3. The mechanism according to claim 1 wherein said first assist spring means comprises a first assist coil spring and a first assist lever movable together with said pedal arm, said first assist spring having a first end portion held stationarily upon said bracket and a second end portion received by said first assist lever so as to move together with same, and first assist lever and said first assist spring being constructed and arranged so that center axes of said first and second end portions of said first assist spring and an axis of rotation of said pedal arm are positioned on a straight line, with respect to a plane of projection perpendicular to the axis of rotation of said pedal arm, when said pedal arm is in said second position.

* * * * *